US011426043B2

(12) United States Patent
Shanafelt

(10) Patent No.: US 11,426,043 B2
(45) Date of Patent: Aug. 30, 2022

(54) PUMICE STONE VACUUM ATTACHMENT

(71) Applicant: Wade Shanafelt, Casper, WY (US)

(72) Inventor: Wade Shanafelt, Casper, WY (US)

( * ) Notice: Subject to any disclaimer, the term of this patent is extended or adjusted under 35 U.S.C. 154(b) by 808 days.

(21) Appl. No.: 16/358,345

(22) Filed: Mar. 19, 2019

(65) Prior Publication Data

US 2020/0297175 A1 Sep. 24, 2020

(51) Int. Cl.
*A47L 9/02* (2006.01)
*A47L 9/06* (2006.01)

(52) U.S. Cl.
CPC ..... *A47L 9/0606* (2013.01); *A47L 9/02* (2013.01); *A47L 9/06* (2013.01)

(58) Field of Classification Search
CPC ..... A47L 9/06; A47L 9/0606; A47L 9/02
See application file for complete search history.

(56) References Cited

U.S. PATENT DOCUMENTS 4,694,529 A * 9/1987 Choiniere ..... A47L 9/02 15/420
2003/0159241 A1* 8/2003 Calzolari ..... A47L 9/02 15/401
2004/0045127 A1* 3/2004 Albert ..... A47L 9/066 15/415.1
2005/0044660 A1* 3/2005 Kim ..... A47L 9/0673 15/415.1
2007/0209154 A1* 9/2007 Griffith ..... A47L 9/1641 15/415.1
2016/0270611 A1* 9/2016 Mast ..... A47L 9/02
2018/0055314 A1* 3/2018 Rupp ..... A47L 9/02

* cited by examiner

*Primary Examiner* — Michael D Jennings
(74) *Attorney, Agent, or Firm* — Peter J Timbers

(57) ABSTRACT

An apparatus to remove hair and debris from carpet and upholstery comprising a pumice stone having a void that is attached to a support having a hole and the pumice stone void is aligned with the support hole and the support is attached to a vacuum wand.

8 Claims, 4 Drawing Sheets

PUMICE STONE VACUUM ATTACHMENT

FIELD OF THE INVENTION

This invention relates generally to an apparatus for attachment to a vacuum for the removal of hair and debris during cleaning of carpets and upholstery.

BACKGROUND OF THE INVENTION

There exists a need to have a more effective means to remove hair and debris from carpet and other upholsteries coupled with already available vacuum attachments and technologies.

SUMMARY OF THE INVENTION

Accordingly, it is an object of embodiments of the present invention to provide an apparatus that allows for quick and thorough hair and debris removal from carpets and upholstery. Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention, as embodied and broadly described herein, the invention comprises a vacuum attachment apparatus comprising: a pumice stone having anterior surface, a posterior surface, a peripheral wall between the anterior surface and the posterior surface and a void between the anterior surface and the posterior surface and the peripheral wall surrounds the void; a support having a front surface, a back surface and a hole between the front surface and the back surface; and the posterior surface of the pumice stone attached to the front surface of the support, the hole of the support overlapping the void of the pumice stone. In other embodiments of the instant invention the vacuum attachment apparatus further comprising a vacuum wand having a distal end which is attached to the back surface of the support. In yet another embodiment of the instant invention, the vacuum attachment apparatus the vacuum wand has a proximal end further comprising a coupler on the proximal end of the vacuum wand for attachment to a vacuum.

Benefits and advantages of the present invention include, but are not limited to, providing a vacuum attachment that allows for efficient effective hair and debris removal from carpet and upholstery.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
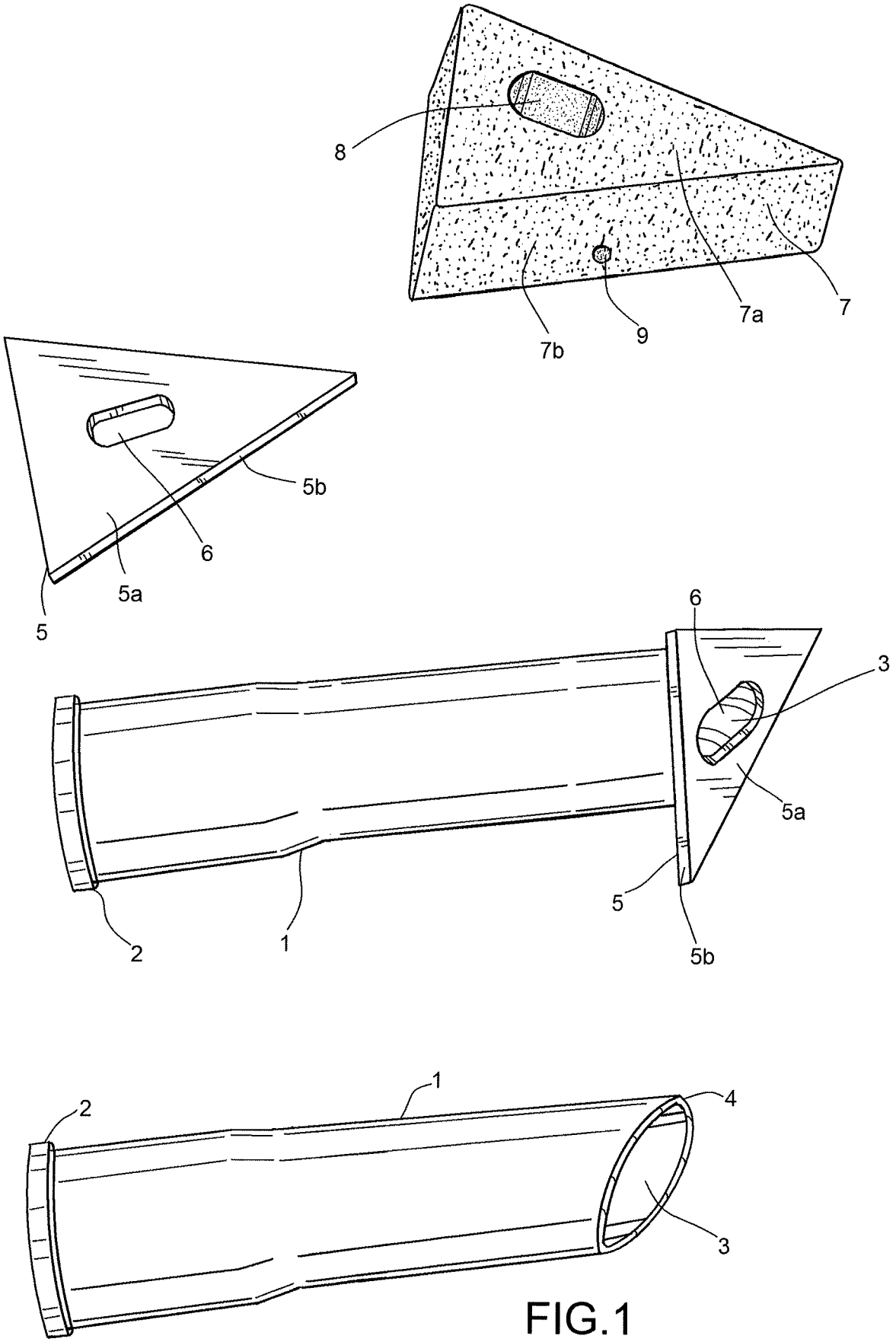
FIG. 1 comprises the component parts of one embodiment of the instant invention depicting the various components including a pumice stone, support and a vacuum wand.

Reference will now be made in detail to embodiments of the invention, examples of which are illustrated in the accompanying drawings. Throughout the following detailed description, the same reference characters refer to the same or similar elements in all figures.

FIG. 1 depicts a side perspective view of a pumice stone 7 having an anterior surface 7*a*, a peripheral wall 7*b*, void 8 and a relief hole 9. The posterior surface of the pumice stone 7 is not depicted; however, it is understood that the void 8 extends between the anterior surface 7*a* and the not depicted posterior surface of the pumice stone 7. The peripheral wall 7*b* surrounds the void 8. The relief hole 9 penetrates the peripheral wall 7*b* to the void 8, providing for air to flow from the region around the peripheral wall 7*b* into the void 8 to aid in hair and debris removal.

FIG. 1 also depicts a perspective view of a support 5 having a front surface 5*a*, a support wall 5*b* and a hole 6. The back surface of the support is not depicted. The hole 6 extends from the front surface 5*a* of the support 5 through to the back surface of the support 5.

FIG. 1 further depicts a side planar view of vacuum wand 1 having a distal end 4 for attachment to the support 5 and the wand 1 having a proximal end having a coupler 2 attached thereto. The wand interior 3 is depicted in the bottom drawing and provides for flow of hair and debris from the distal end to the proximal end and ultimately to the vacuum containment device (not depicted).

FIG. 1 further depicts attachment of the support 5 to the distal end of the vacuum wand 1. The hole 6 of the support 5 overlaps with the void 8 of the pumice stone 7. The arrangement and alignment of the void 8 to overlap with the hole 6 as depicted in FIG. 2, which allows for flow of hair and debris from the area round the anterior surface 7*a* of the pumice stone 7 through the void 8 and through the hole (not depicted) into the wand interior 3 of the wand 1 and ultimately into a vacuum containment device.

Figure 2:
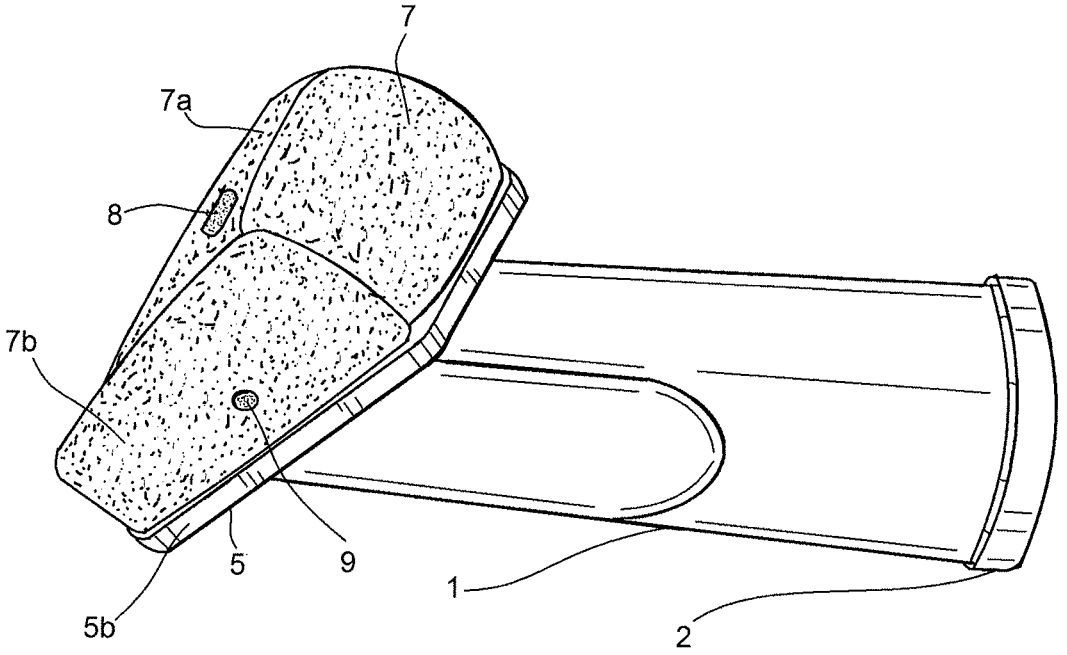
FIG. 2 depicts another embodiment of the instant invention depicting the vacuum attachment apparatus.
Figure 2:
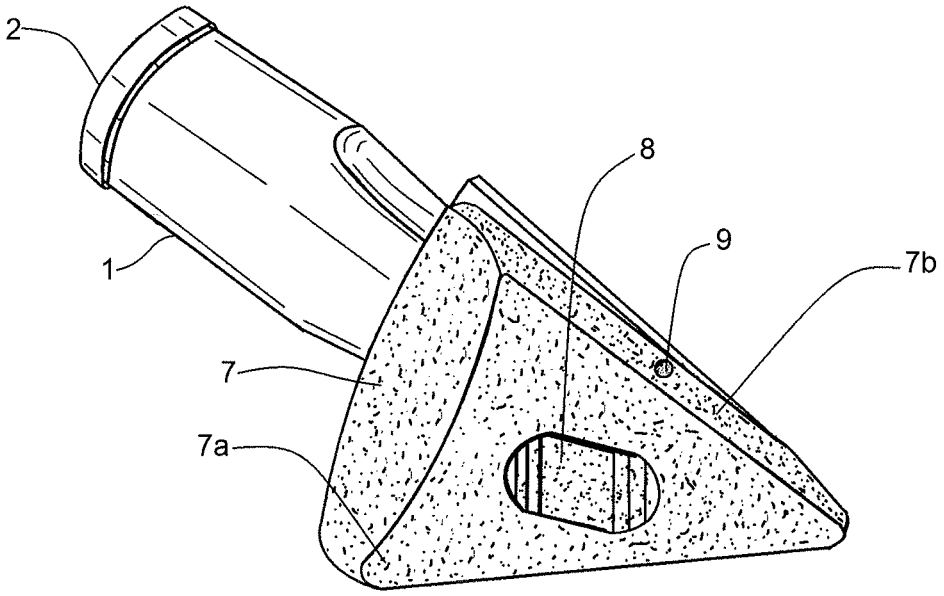

FIG. 2 depicts one embodiment of the instant invention. The top drawing comprises a side perspective view of the pumice stone 7 with the anterior surface 7*a*, the peripheral wall 7*b*, the void 8 the relief hole 9. The posterior surface of the pumice stone 7 is not depicted; however, it is understood that posterior surface attaches to the not depicted front surface of the support 5. The back surface of the support 5 is attached to the distal end of the vacuum wand 1. It is also understood that the void is aligned with the hole, such that in actual use the anterior surface runs along carpet or upholstery and hair and debris is suctioned through the void 8, through the not depicted hole 6 and into the vacuum wand land ultimately into a vacuum hair and debris collection device. The void 8 overlaps with the hole of the support.

The bottom drawing of FIG. 2 depicts a bottom side perspective view of the instant invention. In this depiction of the instant invention, the pumice stone 7 makes contact with carpet and upholstery at the anterior surface 7*a*, dislodging hair and debris which is suctioned through the void 8, through the not depicted hole in the support and into wand interior of the vacuum wand 1 and ultimately transported to a vacuum containment device attached to the wand 1 via the vacuum wand coupler 2.

Figure 3:
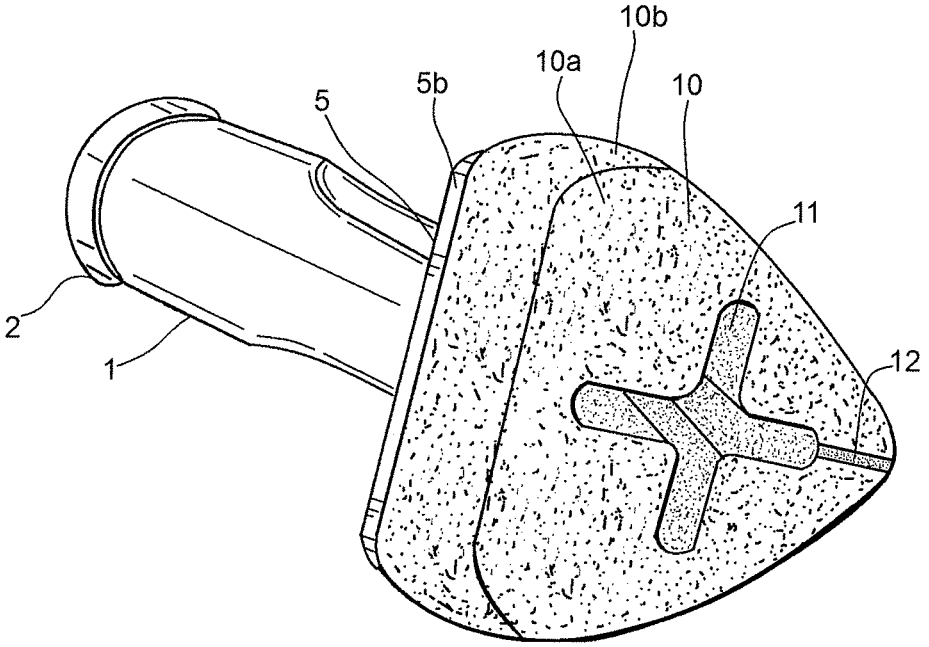
FIG. 3 depicts two embodiments of the instant invention.
Figure 3:
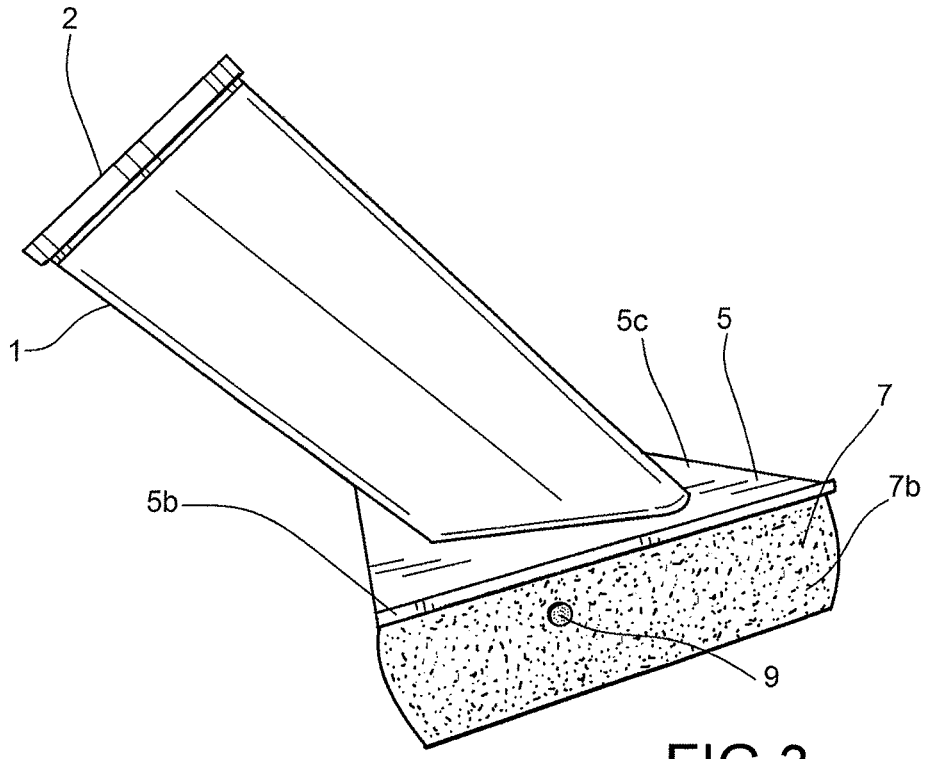

FIG. 3 depicts two embodiments of the instant invention. In the top drawing of FIG. 3, the pumice stone 10 comprises a void 11, which comprises a cross-shape. In addition to the pumice stone 10 having a peripheral wall 10*b* and an anterior surface 10*a*, the anterior surface 10*a* also comprises a relief notch 12 disposed between the void 11 and a portion of the peripheral wall 10*b*. The pumice stone 10 has a not depicted posterior portion that attaches to the front surface of the support 5, which is attached to the distal end of the vacuum wand 1 having a distal end and the coupler 2 at the other end of the vacuum wand.

In the bottom drawing of FIG. 3, another embodiment of the instant invention is depicted, wherein the pumice stone 7 is attached to the support 5 and the back surface 5*c* of the support is attached to the distal end of the vacuum wand. The pumice stone 7 has a relief hole 9.

Figure 4:
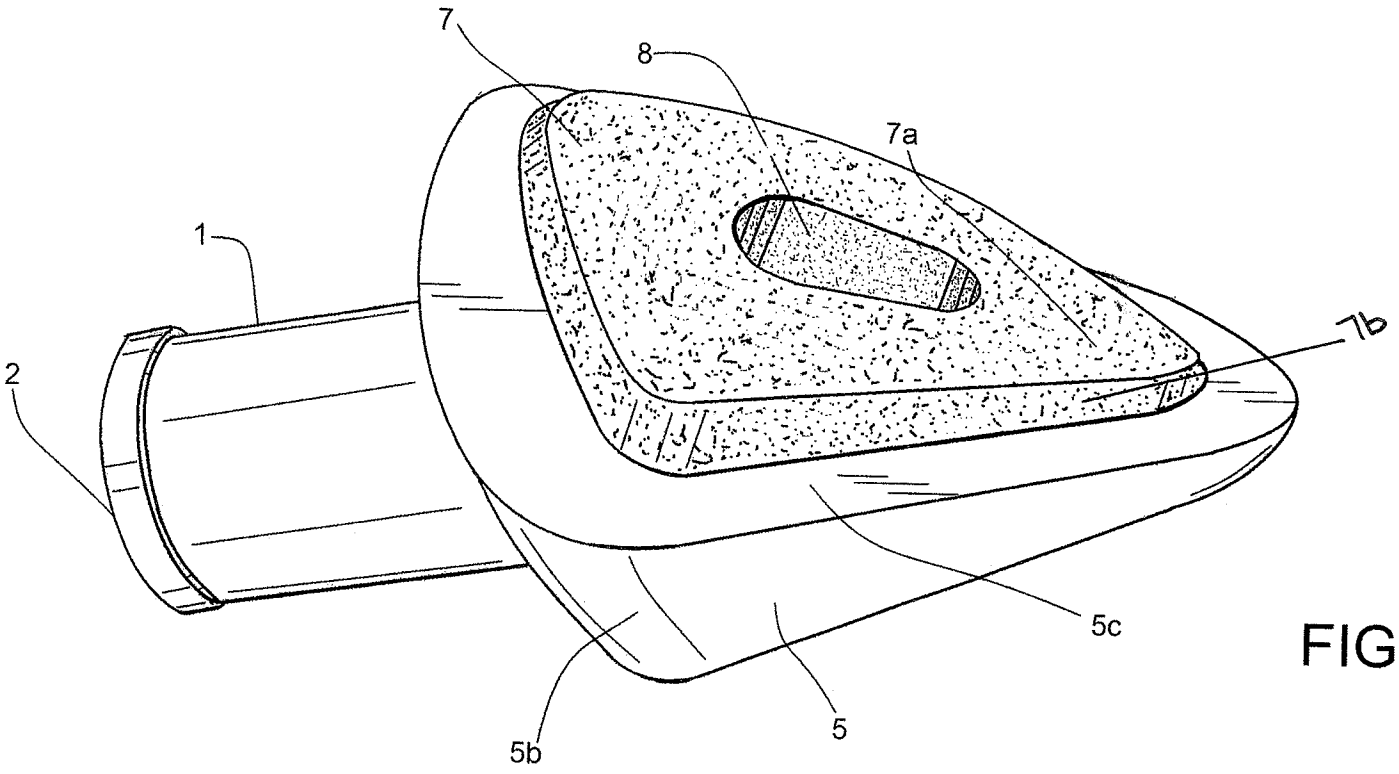
FIG. 4 depicts yet another embodiment of the instant invention.

FIG. 4 depicts yet another embodiment of the instant invention wherein anterior surface 7*a* of the pumice stone 7 comprises an elevated portion near the void 8 and a less elevated portion near at least one portion of the peripheral wall, in this case to the right of the drawing of FIG. 4. FIG. 4 also depicts the support 5 comprising a support wall 5*c* wall between the front surface and the back surface of the support 5 and the support wall 5*c* extending over a portion of the peripheral wall 7*b* of the pumice stone 7.

It is understood within the scope of this invention that the pumice stone may be comprised entirely of naturally occurring pumice stone, artificially made pumice stone or some combination of artificially made pumice stone and naturally occurring pumice stone.

It is believed that the apparatus of the present invention and many of its attendant advantages will be understood from the foregoing description. It is also believed that it will be apparent that various changes may be made in the form, construction, and arrangement of the components without departing from the scope and spirit of the invention and without sacrificing its material advantages. The forms described are merely exemplary and explanatory embodiments thereof. It is the intention of the following claims to encompass and include such changes.

What is claimed is:

1. A vacuum attachment apparatus comprising: (a) a pumice stone having anterior surface, a posterior surface, a peripheral wall between the anterior surface and the posterior surface, a void between the anterior surface and the posterior surface with the peripheral wall surrounding the void, and a relief hole penetrating the peripheral wall; (b) a support having a front surface, a back surface and a hole between the front surface and the back surface; and (c) said posterior surface of the pumice stone attached to said front surface of the support, the hole of the support overlapping the void of the pumice stone.

2. The vacuum attachment apparatus of claim 1, further comprising a vacuum wand having a distal end which is attached to the back surface of the support.

3. The vacuum attachment apparatus of claim 2, wherein the vacuum wand having a proximal end further comprises a coupler on the proximal end of the vacuum wand for attachment to a vacuum.

4. The vacuum attachment apparatus of claim 1, further comprising a relief notch disposed into the anterior surface between the void and the peripheral wall.

5. The vacuum attachment of apparatus of claim 1, wherein the anterior surface of the pumice stone comprises an elevated portion near the void and a less elevated portion near at least one portion of the peripheral wall.

6. The vacuum attachment apparatus of claim 1, wherein the support further comprises a support wall between the front surface and the back surface and the support wall extends over a portion of the peripheral wall of the pumice stone.

7. The vacuum attachment apparatus of claim 1, wherein the pumice stone is at least partially comprised of naturally occurring pumice stone.

8. The vacuum attachment apparatus of claim 1, wherein the pumice stone is at least partially comprised of artificial pumice stone.

* * * * *